United States Patent [19]

Takahashi

[11] 4,219,200

[45] Aug. 26, 1980

[54] DEVICE FOR AUTOMATICALLY ASSEMBLING TILES FOR THE MAH-JONGG GAME

[76] Inventor: Izumi Takahashi, 1-15-4, Heiwadai, Nerima-ku, Tokyo, Japan

[21] Appl. No.: 926,460

[22] Filed: Jul. 20, 1978

[30] Foreign Application Priority Data

Mar. 28, 1978 [JP] Japan ..... 53-34885

[51] Int. Cl.[2] ..... A63F 1/12; A63F 1/14

[52] U.S. Cl. ..... 273/309; 273/149 R

[58] Field of Search ..... 273/149 R, 144 A, 309

[56] References Cited

U.S. PATENT DOCUMENTS 3,899,178 8/1975 Watanabe ..... 273/149 R X

*Primary Examiner*—Anton O. Oechsle

*Attorney, Agent, or Firm*—George B. Oujevolk

[57] ABSTRACT

A device for automatically assembling Mah-Jongg game tiles consists of a table having a plurality of apertures with hinged doors on the surface. A horizontally rotatable disc is centrally located within the interior of the table which cooperates with a slightly inclined rotatable link to transfer the assembled random tiles into alignment. The link leads the tiles to a selector having magnets which attract a metal piece in the tiles having a selected surface facing the magnets. The tiles are carried from the selector to a tile rest station where they are aligned in a row two tiles high. From the rest station the tiles are transferred to a pallet.

1 Claim, 12 Drawing Figures

DEVICE FOR AUTOMATICALLY ASSEMBLING TILES FOR THE MAH-JONGG GAME

BACKGROUND OF THE INVENTION

This invention relates to a device for automatically assembling the tiles necessary for playing the Mah-Jongg games.

BRIEF DESCRIPTION OF THE PROBLEM

In ordinary Mah-Jongg games, it is customery to mix the tiles by stirring them with fingers of players every time one round of games has been finished so as to arrange all of the tiles face down and orientate only a prescribed number of tiles to form two rows, placing one row on top of the other, and disposing each two rows of the prescribed number of tiles on the four sides of the table in parallel relationship to one another to start the next round of games.

As described above, tiles for the Mah-Jongg games have heretofore been aligned and assembled by hand operation of the players themselves in every round.

In the present invention, however, it is designed that two sets of such tiles are to be used so that while one set is being in the game, the other set is being automatically aligned and arranged within the table in order to be ready for use in the next game, this last set being arranged to be promptly delivered onto the table at an electric signal from the upper part of the table.

SUMMARY OF THE INVENTION

Briefly stated, the invention comprises the following construction:

The Mah-Jongg table has a plurality of apertures with hinged doors on the table surface. A horizontally rotatable disc is centrally located within the interior of the table which cooperates with a slightly inclined rotatable link to transfer the assembled random tiles into alignment. The link leads the tiles to a selector having magnets which attract a metal piece in the tiles having a selected surface facing the magnets. The tiles are carried from the selector to a tile rest station where they are aligned in a row two tiles high. From the rest station the tiles are transferred to a pallet.

BRIEF DESCRIPTION OF THE DRAWINGS

The accompanying drawings show one preferred embodiment of the present invention, in which.

DETAILED DESCRIPTION

Now, describing in detail the mechanisms, 1 is a table for playing the Mah-Jongg games, 2 is a leg member for supporting the table.

Figure 5:
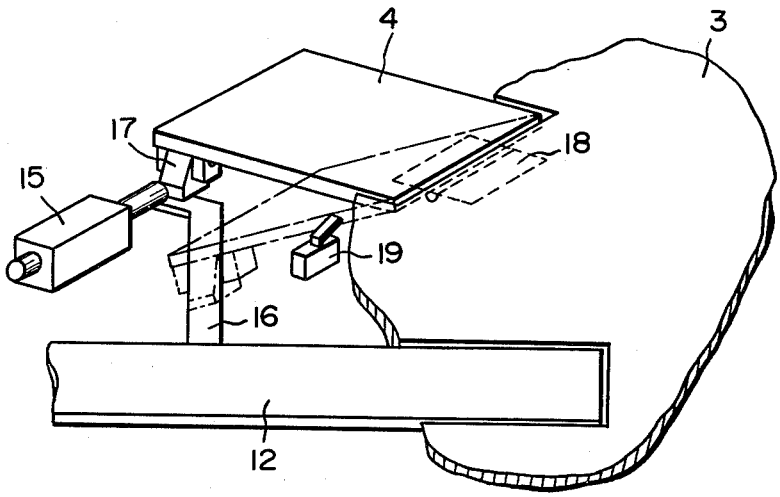
FIG. 5 is a perspective view of the door means with a part cut away.

At the moment when one round of game is over, one of the players sitting in the position adjacent to the starting switch 14 provided on the outer periphery of the top surface of the table 1 pushes the switch to close the electric circuit of this switch so that this electrical signal is transferred to a push type solenoid 15 through the medium of the switch 19 secured to the under surface of the desk 3 near the aperture 4'. As shown in FIG. 5, the door member 4 hinged to one edge of the aperture 4' is held so that its top surface may be flush with the upper surface of the desk 3, with the pawl 17 affixed near the end of the door member 4 being engaged with the support arm 16 projecting from the middle portion of a pallet 12, to which is secured the arm 16. By an electric signal received from the starting switch 14, a push type solenoid 15 is energized to cause the end of a plunger (movable iron core) to take away the pawl 17 from the support 16 so that the door member 4 of the aperture 4' may be swung down with a hinge 18 as its axis to the position shown with the chain line, thus providing the aperture 4' on the deck 3, and through this aperture the tiles are thrown by the players into the interior of the table after one round of games is over.

Figure 6:
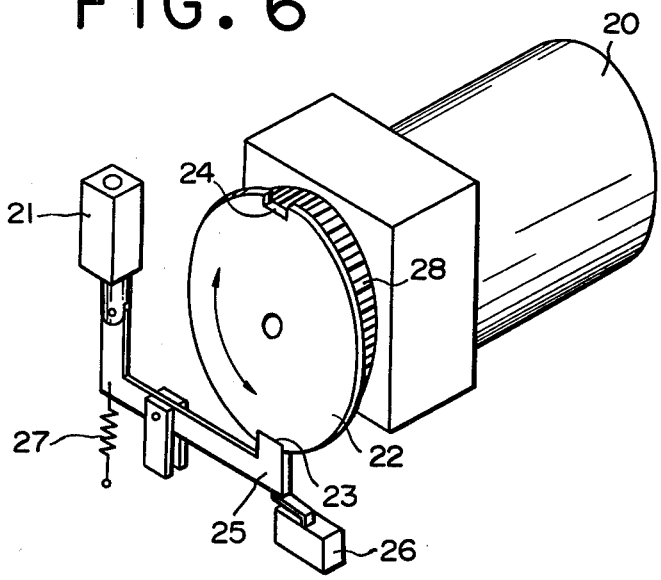
FIG. 6 is a perspective view of the half-rotation mechanism.

On finishing the throwing of tiles into the table, the player pushes again the starting switch 14 to provide an electric signal to cause the switch 19, which has its circuit now being changed over under the pressure of the back surface of the lowered door member 4, to send an electric signal to the solenoid 21 for a half rotation provided near the motor 20 for the crank. As shown in FIG. 6, the energized solenoid 21 draws the plunger to disengage the pawl 25 connected to the solenoid from the slotted portion 23 of the half-rotation wheel 22 secured to the shaft of the motor 20, closing at the same time the circuit by pressing the switch 26 connected on the under side thereof to the driving circuit of the motor so that the motor 20 for the crank will start its rotation. When the wheel 22 has made a half rotation, the slot 24 which is provided on the side diametrically opposite to the slot 23 comes round to the lower position to admit the pawl 25 thereinto with the controlling force of a spring 27 to thus suppress the rotation of the motor as well as to open the electric circuit of the switch 26, thus causing the rotation of the wheel to stop.

This rotational movement of the wheel is transmitted to the crank shaft 29 positioned directly below the pallets 12 which are arranged in the four directions on the table.

Figure 7:
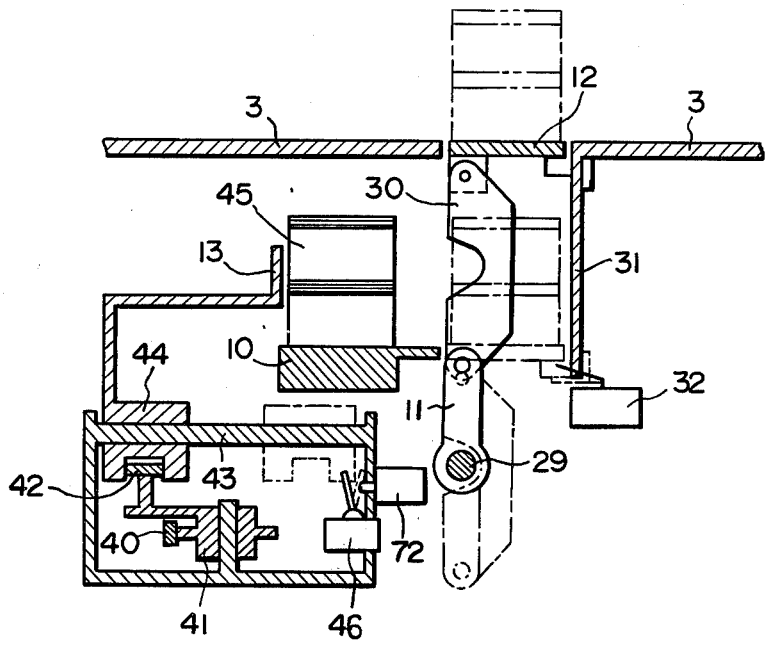
FIG. 7 is a sectional view of the crank mechanism and the press plate means.

The pallets 12 and the crank shaft 29 are connected and held at their two points by means of the crank mechanism as shown in FIG. 7. Namely, the pallet 12 is supported by the rotational shaft at the top of a crank rod 30 and it comes down perpendicularly through the guidance of a guide plate 31 by a half rotational movement of the crank shaft 29 and stops at the lowest position indicated with chain line in the drawing. At this moment, at the lowest possible point the pallet presses with its under surface the switch 32 to close the electric circuit by means of which is transmitted an electric signal to the solenoid 34 provided near the motor 33 for a half rotation.

Figure 8:
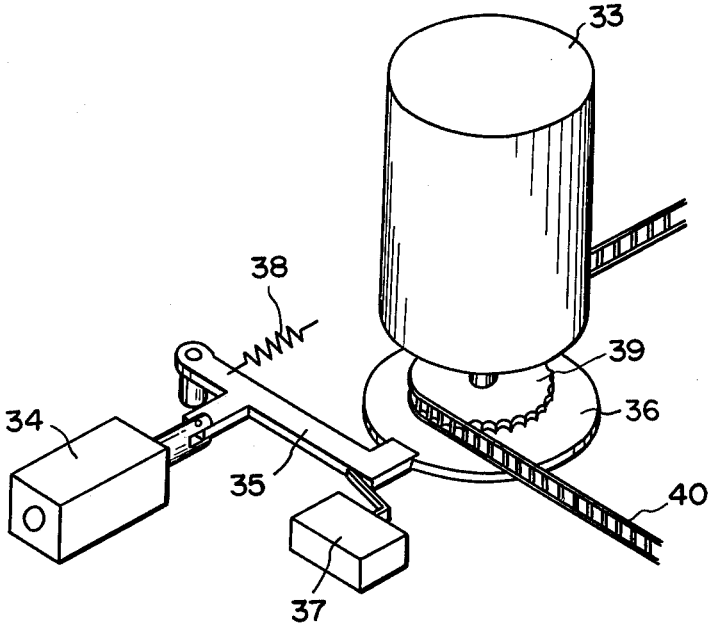
FIG. 8 is a perspective view of the single rotation mechanism.

This rotation mechanism is shown in FIG. 8, wherein the solenoid 34 is energized upon receipt of an electric signal from the switch 32 and simultaneously with withdrawal of the pawl 35, which is connected with the plunger (movable iron core), from the slot of the single rotation wheel 36 secured to the rotational shaft of the single rotational motor 33, the electric circuit of the switch 37 continued to the driving circuit of this motor is closed so as to start the motor to rotate. At the moment when the wheel 36 has made one full rotation, the pawl 35 will again engage with the slot of the single rotational wheel 36 through the controlling force of the spring 38 and suppress the rotation of the motor and at the same time open the circuit of the switch 37 so that the motor stops at the position when it has made one full rotation. This one rotational movement will be transmitted to the chain 40 from the sprocket 39 provided coaxially with the motor 33 and further to the sprocket 41 of the press plate device 13 disposed centrally below the tile dealing rest 10 arranged in the four directions. The sprocket 39 referred to in the description of the single rotational device and the sprocket 41 to be used for this press plate are provided with the same number of teeth so that the transmission of the one rotational movement is ensured by the chain 40.

The press plate device is shown in FIG. 7, wherein the sprocket 41 has an arm secured to its upper surface and a roller 42 is provided on the top of the arm. The under surface of the slider member 44 secured to the guide rod 43 has a transverse slot provided perpendicularly to the guide rod, into which slot is fitted the roller 42. The slide member 44 will make one reciprocating motion along the guide rod 43 through one rotation of the sprocket 41. By this rotation, the press plate 13 secured to the upper part of the slide member 44 will move the two rows of tiles placed one on the other already arranged just in a predetermined number on the tile dealing rest 10, to the position on the pallet 21 indicated with chain line, said pallet having been already lowered and retained in the position. Also, at the foremost position of the reciprocating motion, this slide member 44 pushes the projecting lever of a snap switch 46 down to the opposite direction to thus form the circuit of reverse rotation of the motor 20 for the crank, sending at the same time an electric signal also to the solenoid 21 for a half rotation and further close the driving circuits of the motor 47 for the chain conveyor and the motor 48 for the slope conveyor to provide conduction therebetween.

The electric signal transmitted to the solenoid 21 for a half rotation causes the half rotation mechanism of FIG. 6 to make a counterclockwise half rotation to the crank shaft 29 by means of the afore-mentioned transmission of the electric signal so that the crank mechanism shown in FIG. 7 makes a counterclockwise half rotation, and the pallet 12 is lifted up with the rows of tiles 45, indicated with chain line, placed thereon and stops at the position with its upper surface being flush with the upper surface of the desk 3. These rows of tiles, shown with chain line, are lifted from the four directions onto the deck to form each two rows of tiles, with one row placed on top of the other to go into the next round of games. During the course of lifting up the pallet 12, the top end of the support arm 16 projecting from the pallet 12 as shown in FIG. 5 closes the aperture 4' by pushing up the pawl 17 and accordingly also the door member 4, making it perfectly possible to start the next game.

Figure 1:
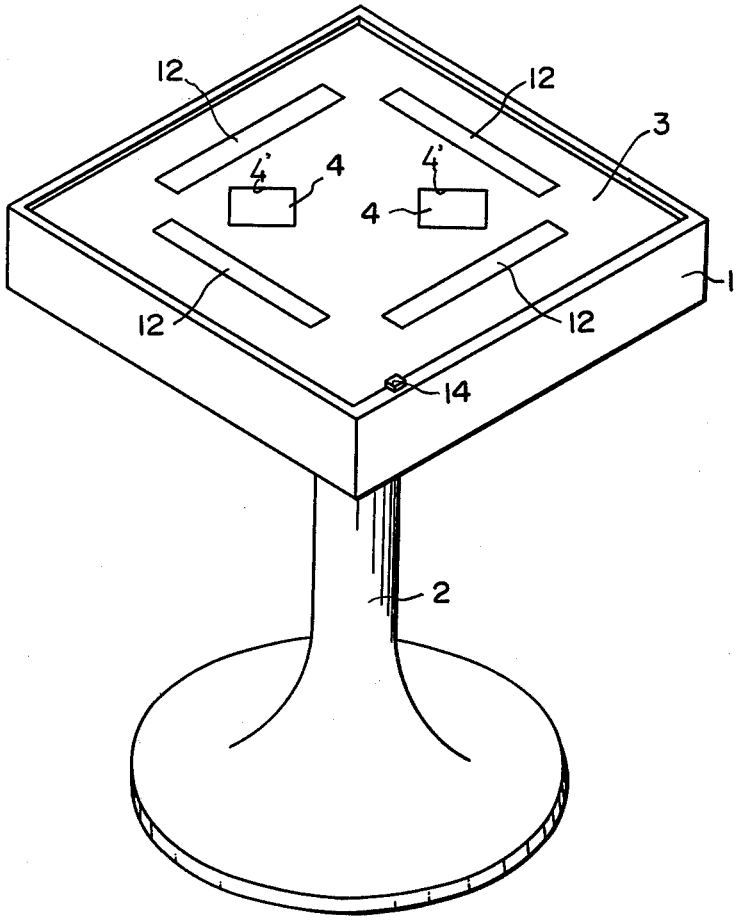
FIG. 1 is a perspective view of the external appearance of the Mah-Jongg game table containing a device of this invention.
Figure 2:
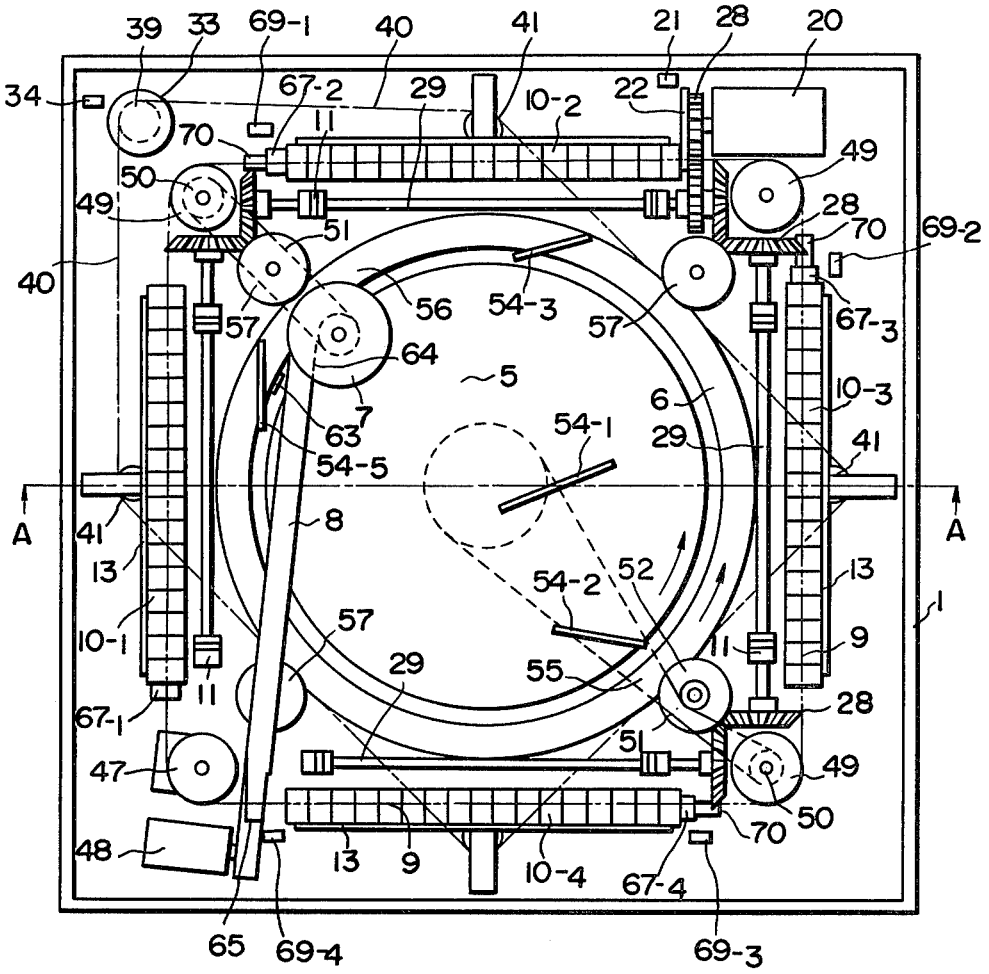
FIG. 2 is a top plan view of the internal mechanism.
Figure 3:
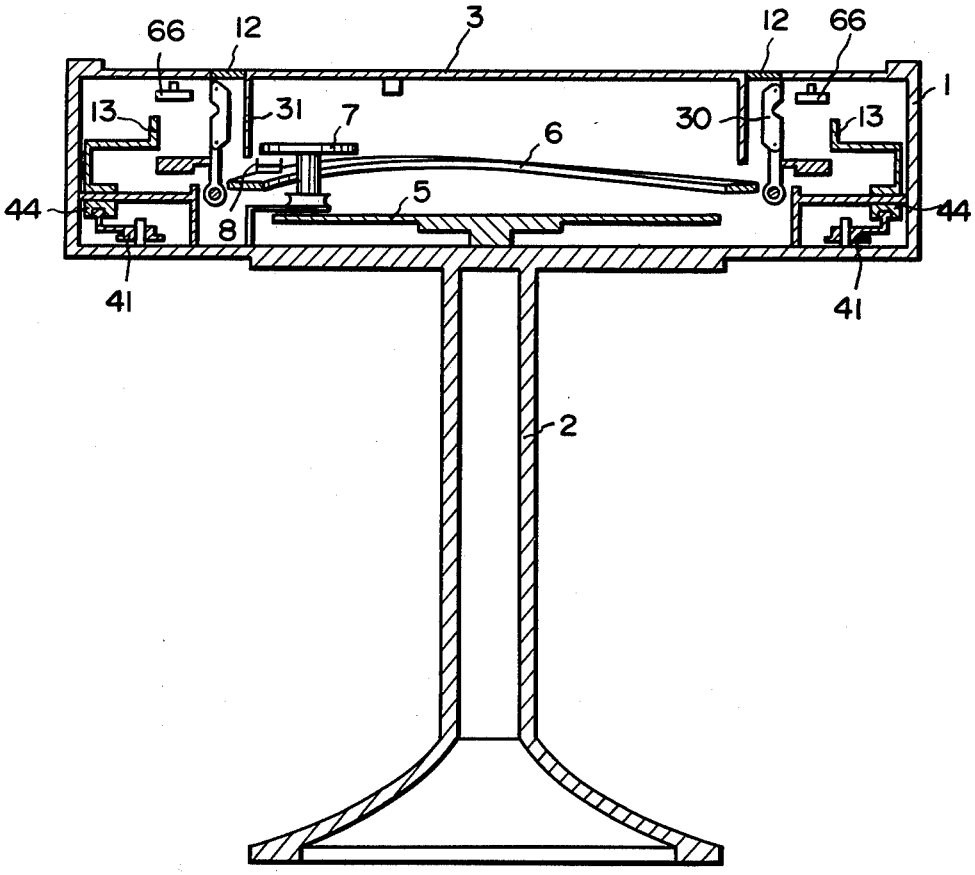
FIG. 3 is a vertical sectional view taken along the line A—A of FIG. 2.
Figure 4:
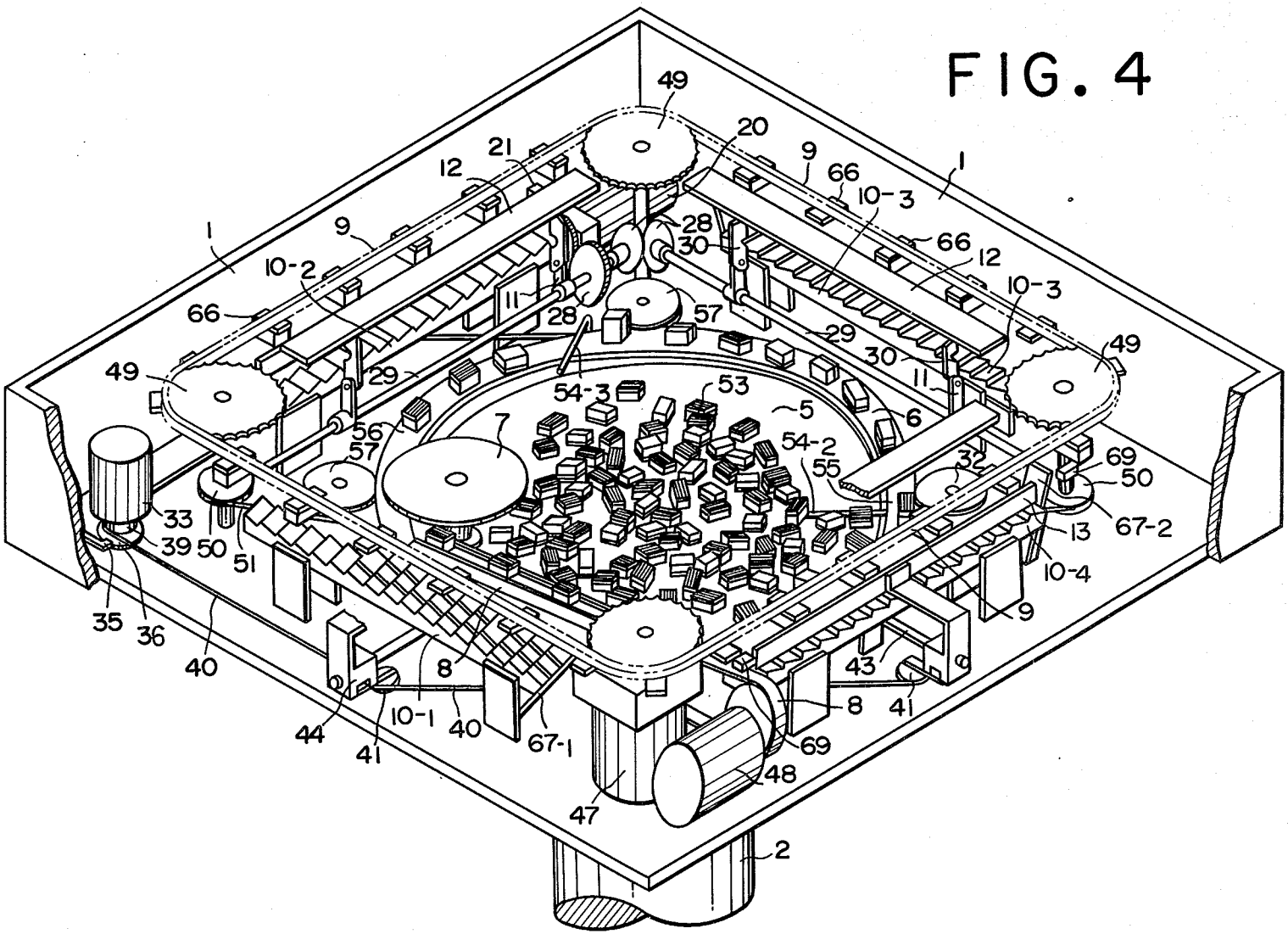
FIG. 4 is a perspective view of the internal mechanism with a part cut away.

The motor 47 for the chain conveyor as well as the motor 48 for slope conveyor with their drive circuits having been closed by the snap switch 46 start to rotate, and the chain conveyor 9 further transmits the rotation to another sprocket 49 and, as shown in FIGS. 2 and 4, the belt pulley 50, secured coaxially with this sprocket, transmits the rotation from a turntable 5 and a friction wheel 52, by means of a belt 51, to a link 6 and to a selector 7.

As described herein at the beginning, the group of tiles 53 thrown into the table through the aperture 4' are first laid or piled up one upon the other in disorder on the turntable 5 as shown in FIG. 5, and along with the rotation of the turntable the group of tiles also rotate so that they are gradually moved towards the peripheral portion of the turntable by the barrier bar $54_{-1}$ as shown in FIGS. 2 and 4 and further onto the outer link 6 by the barrier bar $54_{-2}$.

The link 6 is inclinedly supported for rotation by the friction wheel 52 and the guide wheels 57 at three locations such that it may be lowest at the position indicated with reference number 55, the position being lower than the upper surface of the turntable, and also it may be a few centimeters higher than the turntable at the opposite position indicated with the reference number 56.

The tiles induced onto the link 6 moves thereon with the link, and the tiles that are in the states other than in flat down, namely, those tiles that are in upright positions or lying sideways may either be thrown down by the barrier bar $54_{-3}$ or returned again onto the turntable. Thus, only those tiles that are in flat down positions will be allowed to pass direct under the selector 7.

Namely, as shown in the drawings, the tiles moving on link 6 under the selector 7 with their back plates facing downwards collide against the barrier bar $54_{-5}$ disposed above the link 6 crossing it obliquely. Due to this collision, the tiles fall in a substantially oblique direction downwards from the upper surface of the link, collide against a reversal projection 63 which is an arm-like bar, with their side surface facing upwards so that they fall down further onto the turntable with their letter or symbol side facing downwards and with their back plates facing upwards. Thus, the tiles are turned down and move on the turntable with their back plates facing upwards.

Figure 9:
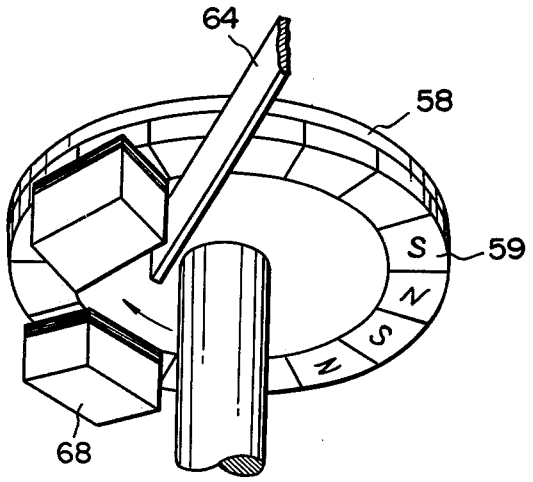
FIG. 9 is a perspective view of the selector viewed from below.

With reference to the selector 7, FIG. 9 shows that a number of permanent magnets 59 such as ferrite are secured successively to the peripheral under surface of the rotatable disc and they are supported at such a level that a small clearace may be provided to allow the down flat tiles to pass therethrough.

Figure 10:
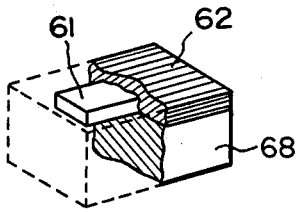
FIG. 10 is a perspective view of the tile with a part cut away.

Here, it is to be noted that each of the tiles to be used in the embodiment of the present invention is provided with an iron weight 61 embedded in the location adjacent to the surface of its back plate 62 as in the tiles shown in FIG. 10.

By this fact, among the tiles which are down flat passing directly under the selector 7, those which are in a position with the back plate 61 facing upwards are energized with the iron weight 61 embedded therewithin and spring up to be attracted by the magnet. At this moment, when the tiles spring up and are attracted due to the fact that the permanent magnets are arranged with their N and S poles disposed alternately with each other and that the iron weight is embedded longitudinally within the tiles, the position of those tiles that are attracted in accordance with the feature of the magnet will natually be arranged with their length to be in parallel to the tangent of the disc 58 and the position of the tiles is uniformly controlled in this direction.

The tiles passing with their back plate held on their under surface are in the exterior of the energizing field of the magnet and pass without being attracted and returned by a barrier bar 54-$_5$ onto the turntable 5 where they are in the position higher than the turntable, so that they move by falling down from the link. In the course of falling down, however, these tiles collide with and are hit by the reversal projection 63 disposed along the travel path and move onto the turntable in the reversed position with their back plate facing upwards. The tiles thus moved are again transported direct under the selector and attracted through the steps as mentioned above. This serves to improve the attracting efficiency of the selector and raises the probability of controlling the position of the tiles.

The tiles attracted by the permanent magnets 59 of the selector 7 are guided through this rotational motion to the induction plate 64 secured to and extended from the end of the slope conveyor 8 and are compelled to move outwardly of the selector to finally leave the field of energization and fall down onto the slope conveyor 8. The tiles which have thus fallen down onto the conveyor are transferred carried thereon and the forward movement is prevented by a stopper 65. At this moment, they are attracted and transported by the hanger member 66 of the chain conveyor 9 which is moving direct above the tiles with a slight gap therebetween and perpendicularly to the slope conveyor.

Figure 11:
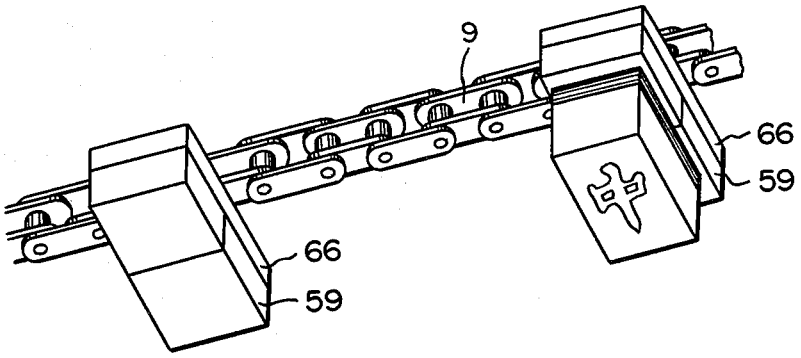
FIG. 11 is a perspective view of the chain conveyor viewed from below.

The chain conveyor 9 is shown in FIG. 11. This conveyor is constructed with an ordinary chain to which are secured with an attachment a number of base plates for a hanger member 66 at a predetermined spacing, and to the under surface of each of these base plates there is secured at least one permanent magnet 59, and when the conveyor passes direct above and very near to the tiles which are in a state of suspension by the stopper 65 of the slope conveyor 8, it attracts the tiles and transports them in the state of being suspended direct above and quadrilaterally along the center line of the tile dealing rests 10 arranged on the four sides of the table. The tiles to be transported are first prevented from movement by a fixed damper 67-$_1$ at one end of the tile dealing rest 10-$_1$ they are separated from the permanent magnet of the hanger member and fall down and rest onto the tile dealing rest 10-$_1$.

Figure 12:
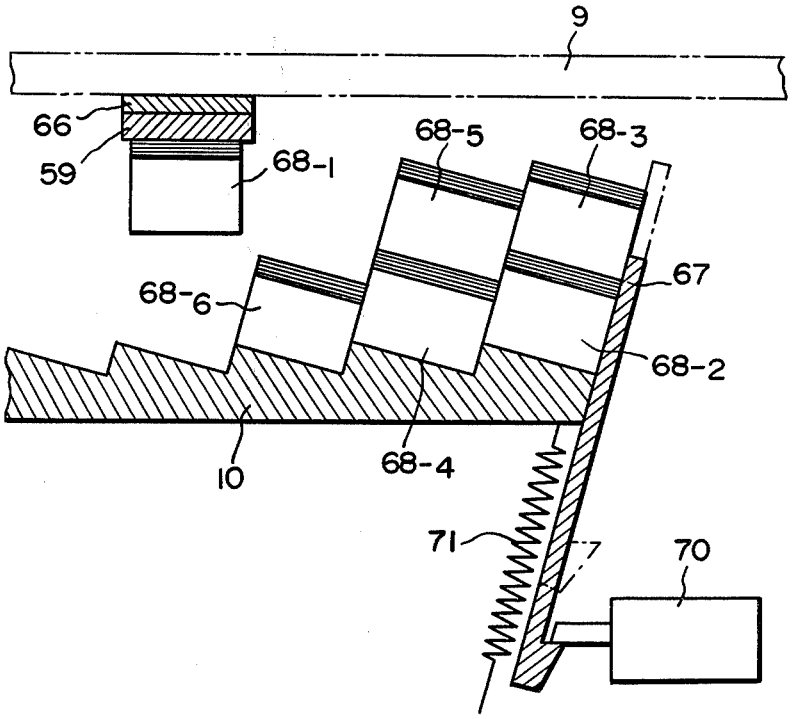
FIg. 12 is a sectional view of the damper portion and drawing up sequence of the tiles.

As shown in the sectional view of FIG. 12, the tile rest 10 has a top surface which is serrated in cross-section forming steps which are the width of a tile and also is provided with a damper 67 at the forward end in the direction of movement, said damper being slightly slanted. Only the damper of the tile dealing rest 10-$_1$ is securely fixed and the dampers of other tile dealing rests 10-$_2$, 10-$_3$, and 10-$_4$ can move vertically and usually they are stationary in a lower position so as to allow the suspended tiles to pass above them.

Now, referring to FIG. 12, description will be made how to pile up the two rows of tiles one on top the other on the tile dealing rest. The suspended tile 68-$_1$ is carried towards the damper 67 which will prevent only the tiles from advancing further so that the tiles will drop from the hanger member 66 and fall down onto the tile dealing rest in the position of 68-$_2$. The suspended tile having been carried forward next will also be barred by the damper to advance further and fall down onto the tile 68-$_2$, namely, into the position 68-$_3$ and be settled. The suspended tile which has been carried forward next will be prevented from the further movement by the tile 68-$_3$ which fell down immediately before and will rest in the position 68-$_4$. The tiles will thus be piled up in sequence in the order of positions such as 68-$_5$, 68-$_6$ and so on, started from the forward end of the tile dealing rest repeatedly to the lower seat and next to the upper seat as far as a predetermined number of tiles (usually 34 tiles) is attached. This predetermined number can successively be read electronically by means of a photoelectric switch 69-1 provided at the position immediately after the damper 67-$_2$ of the tile dealing rest 10-$_2$ has passed. This numerical value is taken into a counter-IC separately provided, and when the predetermined number of tiles 34 are attained, this will be detected by means of a NAND GATE-IC etc. and promptly fed to the solenoid 70 for dampers as an output signal.

The solenoid 70 which has received the electric signal attracts the plunger and, as shown in FIG. 12, the end of the solenoid 70 will be removed from the projection provided on the lower portion of the damper 67 so that the damper will be moved to the upper position by the restoration spring 71 and thereafter it will prevent tiles from being received thereon. By this arrangement the tiles are assembled in two rows and piled one on top of the other at the tile dealing rest station 10-2 and similarly at the tile dealing rest station 10-1.

The photoelectronic switch 69-2 which is in the damper position of the tile dealing rest 10-$_3$ reads the prescribed number, $34\times2=68$, and promptly sends out an electric signal through a counter-IC, NAND GATE-IC, etc. which will be transmitted to the solenoid 70-$_2$ for the damper to move the damper 67-$_3$ to the upper position similarly as in the previous case, preventing the tiles thereafter from passing, thus commencing the operation of piling two rows of tiles one upon the top of the other on the tile dealing rest 10-$_3$. Thus, the operation is successively continued to finally attain the tile dealing rest 10-4, and when the photoelectric switch 69-$_4$ situated oppositely to the damper of the tile dealing rest 10-$_4$ has read the prescribed number, $34\times4=136$, namely, the last tile number, the electric signal produced through the IC is sent to the push type solenoid 72 shown in FIG. 7 to operate the plunger, the top end of which pushes the projecting lever of the snap switch 46 down forwardly to open the circuits for the motor 47 for the chain conveyor and the motor 48 for the slope conveyor, switching at the same time the circuit for the reversal rotation of the motor 20 for the crank to the circuit for the positive rotation. In this manner, all the movement is stopped and the rows of tiles assembled on the tile dealing rests on the four sides are now ready only to await their turn for the game to be played.

In the meantime, at the moment when the game which had been played on the table has been finished, the starting switch is pushed again to start the next game. Thus, a series of game cycles is repeated and the game is proceeded one after another.

The afore-mentioned dampers 67-$_2$, 67-$_3$, and 67-$_4$, situated in the upper position, are pushed down by projecting part of the pallet 12 descending at the beginning of the game and are returned to the orignal position by being hooked by the top end of the solenoid for the damper.

According to the present invention, of the two sets of tiles to be used for the game, one set is being used while the other set is automatically assembled within the table so as to be ready for use so that it is possible to proceed the games continuously without interruption by alternately using the groups of tiles. Moreover, it is not only possible for the players not to be troubled with operations for assembling or arrangement of tiles which is not at all the essence of games, but also to devote themselves to the playing per se. Furthermore, any tampering in assembling or arranging the tiles can completely be avoided so that fairness of games is insured. It is also advantageous that noises peculiar to the Mah-Jongg games is to the great extent absorbed within the table, thus enabling the players to be freed from troubling others, the matter being often criticized, and that the Mah-Jongg game is sublimated to be a quiet and smart indoor game.

What is claimed is:

1. A game table with a mechanism for automatically assembling tiles which have an iron piece adjacent one surface in rows at least two tiers high, comprising in combination:

(a) a horizontal flat deck as a part of said table with at least one aperture (4') in said deck, and a door (4) hinged thereto, flush with said deck, an arm (16) holding said door normally shut, a pawl (17) engaged with said arm (16) and a solenoid (15) which when energized will move said pawl (17) to allow said door to swing partly open so that tiles on said deck can be discharged downwards at random;

(b) a horizontal turntable with an upper surface (5) under said deck, receiving said tiles with a plurality of barrier bars (54-1; 54-2) to overturn upright tiles and make them lie flat and to move the tiles to the turntable periphery;

(c) a circular link (6) disposed around the turntable having one portion of its periphery lower than the upper surface of the turntable receiving flat down tiles thereon from said turntable, and carrying said tiles along a first travel path;

(d) rotating selector means (7) with an underside along said travel path so disposed that the tiles on said link (6) pass thereunder, magnets (59) at said underside disposed to attract those tiles having an iron piece at the surface adjacent said magnets (59), the remaining tiles being returned by said link to said turntable surface (5) where they are again turned around by barriers and again moved onto said link (6), whereas the tiles attracted by said magnets to said underside travel along a second travel path with said selector means (7);

(d) a plate (64) along said travel path and a slope conveyor (8) disposed for cooperation with said plate (64), said plate blocking further movement of said tiles along said second travel path and forcing them onto said slope conveyor, said slope conveyor (8) having a stopper (65) at one end;

(e) chain conveyor means (9) with magnets (59) at the underside thereof disposed to pass by said stopper (65) and pick up said tiles and carry them along a third travel path;

(f) a vertically movable tile rest (10) along said third travel path, said tile rest having a serrated cross-section forming steps along the upper portion thereof, said steps being inclined to both the horizontal and vertical, said tile rest (10) having an inclined damper at one end (67) so that at least the first two tiles carried under said chain conveyor means (9) will hit said damper end in succession to be stacked one on the other, the other tiles successively hitting the upper tile of the stack previously formed to form a row of tiers of tiles;

(g) releasable means (70) holding said tile rest and a spring means (71) pushing said tile rest (10) up vertically when said releasable means is released;

(h) a pallet (21) disposed for receiving the tiles from said tile rest (10); and, (i) slide means (44) to move the tiles from said tile rest (10) to said pallet.

* * * * *